United States Patent [19]

Pyne et al.

[11] 4,445,430

[45] May 1, 1984

[54] METHOD AND APPARATUS FOR SORTING, COUNTING AND FLATTENING CANS

[76] Inventors: Melvin L. Pyne, P.O. Box 997, Brookings, Oreg. 97415; Robert B. Allsup, Box 2053, Harbor, Oreg. 97415

[21] Appl. No.: 315,554

[22] Filed: Oct. 27, 1981

[51] Int. Cl.[3] ..... B30B 9/32

[52] U.S. Cl. ..... 100/35; 100/99; 100/173; 100/176; 100/902; 209/551; 209/702

[58] Field of Search ..... 100/902, 99, 35, 41, 100/91, 173, 176; 209/702, 551, 942, 703

[56] References Cited

U.S. PATENT DOCUMENTS

| | | | |
|---|---|---|---|
| 2,558,255 | 6/1951 | Johnson | 100/902 |
| 3,066,600 | 12/1962 | Couty et al. | 100/176 |
| 3,327,942 | 6/1967 | Blume | 209/551 X |
| 3,406,624 | 10/1968 | Kutchera | 100/176 |
| 3,504,621 | 4/1970 | Qualheim | 100/176 X |
| 4,059,050 | 11/1977 | Davis | 100/173 X |
| 4,358,995 | 11/1982 | Ballo | 100/173 X |
| 4,369,699 | 1/1983 | Dailey | 100/902 X |

*Primary Examiner*—Billy J. Wilhite
*Attorney, Agent, or Firm*—Donald C. Feix

[57] ABSTRACT

A can sorting, counting and flattening machine flattens empty cans by folding the can body over the back side of the ring or top end of the can so that both the brand name of the can on the can body and all identifying indicia on the ring end of the can are easily readable after the can has been completely flattened in a one step operation by a single machine operator. The machine employs a series of resettable counters which automatically count the total number of each brand of cans, the total number of cans returned per individual customer and the total number of cans reprocessed by the machine in a given time period.

25 Claims, 7 Drawing Figures

44
46
98
48
32
42
98
30
100
52
98
50
94
58
99
92
100
54
56
22
72
94a
74
70
58a
98
92a
88
98
80
36
76
78

METHOD AND APPARATUS FOR SORTING, COUNTING AND FLATTENING CANS

BACKGROUND OF THE INVENTION

This invention relates to an apparatus and method for sorting, counting and flattening empty cans.

The invention relates particularly to a method and apparatus for sorting, counting and flattening used beverage cans so that all identifying indicia on the ring or top of the can, as well as the brand name of the can, are easily readable after the can has been completely flattened.

The present invention also relates to a unique method and apparatus for providing an accurate count of the cans processed thereby. The counting function simultaneously counts the total number of cans of any particular brand, the total cans returned to a store owner by any particular customer, and the total number of cans of all brands processed through the machine in a given time period, i.e. a daily or weekly total, etc.

The method and apparatus of the present invention accomplishes all of these functions in a simple one step operation for a single operator.

The recycling of used metal cans is becoming increasingly important with more and more states having mandatory beverage can deposit laws.

The handling of the cans to be recycled is facilitated by flattening the cans because flattening reduces the bulk to at least 20 percent of the original bulk. Flattening of empty cans greatly reduces the space required to store and ship the empty returned cans.

In order to minimize storage problems it is essential that the empty cans be flattened as early as possible in the recycling process. There exists today, in states like Oregon, a critical need for a can flattening machine that is small enough and inexpensive enough to be installed at each individual retail outlet that sells canned beverages. These retail outlets are the first point at which substantial numbers of empty cans are accumulated when returned for the recycling process.

It is also essential that the machine flatten the cans in a manner to allow the brand name and State or Federal deposit information embossed on the ring end of the can to be easily read. The state law of Oregon requires that the deposit information on the ring end of the flattened can be readable.

This problem is further compounded where you have neighboring states, like Oregon, which has beverage can deposit requirements, and California which has no beverage can deposit requirement. The store owner must make the initial deposit on such beverage cans and he only gets a refund from the distributor on cans that he returns with the deposit information thereon clearly and easily readable. Thus it is very important to the store owner that he not pay out money to can returning customers on returned cans which originate in non-deposit states.

A store owner in Oregon, for example, must pay the distributor five cents per can as a deposit when the distributor sells the cans of beverages to the store. The store owner then collects a five cent per can deposit from customers to whom the store owner sells the beverages.

If the customer drinks the beverage right there and turns the can in, the store owner has to immediately return the five cent deposit to the customer. But, the store owner cannot recover his five cent deposit until he returns the cans to the distributor.

Consequently, during the lag period between the time the store owner receives the empty cans from his customers and the time the store owner returns these empty cans to the distributor, the store owner is literally financing the distributor. The money involved is substantial. A large chain retail store might be selling and receiving 10,000 cans per day.

Obtaining an accurate count of recycled cans has presented yet another problem for the store owner. Prior art methods of counting returned cans has proven to be very unsatisfactory for store owners.

In the prior art method of counting, a standard sized plastic bag is supplied the store owner by the beverage distributor. The bags are then filled and tied at the top and it is estimated that there are a given number of cans in the bag.

In a typical prior art estimated count situation it is standard procedure to estimate the bag count at 350 cans per bag. In fact, there may be as many as 400 to 450 cans per bag depending upon how crushed the cans are which determines how much bag space the cans occupy.

There is a slight possibility of an undercount factor of perhaps five percent. However, the likelihood of any significant undercount is very slight because the distributor can visually determine by looking at the height of the bag if the bag is substantially underfilled. Again, it is the store owner who bears the economic brunt due to the high possibility that most bags will have a significant overcount under the prior art counting system of estimated cans per bag. In any event either the store owner or the distributor loses money on such estimated count methods which are not accurate.

SUMMARY OF THE INVENTION

It is a primary object of the present invention to provide a method and apparatus to sort, count and flatten cans in a one step operation which eliminates manual counting by the operator and which flattens the cans in a manner whereby both the brand name of the can and all deposit information on the ring end of the can are easily readable after the can has been completely flattened.

It is a related object of the invention to construct a machine which will produce an accurate count of the various brands of cans processed through the machine, the total number of cans returned per individual customer and the total number of cans processed by the machine in a given period of time.

Another important object of the present invention is to construct a simple low cost machine which a single operator may run in a one step operation without interruption.

The machine of the present invention includes a can bin for receiving empty beverage cans.

A load of cans of various brand names is dumped into the can bin. The operator then picks cans at random from the can bin and matches the brand on the can with a correspondingly branded can tube.

The operator then drops the can down the proper branded can tube and the machine functions automatically to sort, count, flatten and deliver the processed cans to branded can boxes beneath the machine.

When a particular branded can box contains a predetermined number of cans of that brand a buzzer and/or flashing light associated with the individual can tube counters alerts the operator. The operator then removes the full box and replaces it with an empty box and resets the individual branded can tube counter.

The flattening process is accomplished by flattening the can between two juxtaposed oppositely rotating rollers. One roller has gripping means in the form of raised cleats to grip one end of the can so that as the can is flattened between the rollers the can body is folded over the back side of one can end so that both the brand name on the can body and all identifying deposit indicia on the one can end are easily readable after the can has been completely flattened.

Other and further objects and advantages of the present invention will be apparent from the following description and claims and are illustrated in the accompanying drawings which, by way of illustration, show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing friom the present invention and the purview of the appended claims.

DESCRIPTION OF THE PREFERRED EMBODIMENTS

Figure 1:
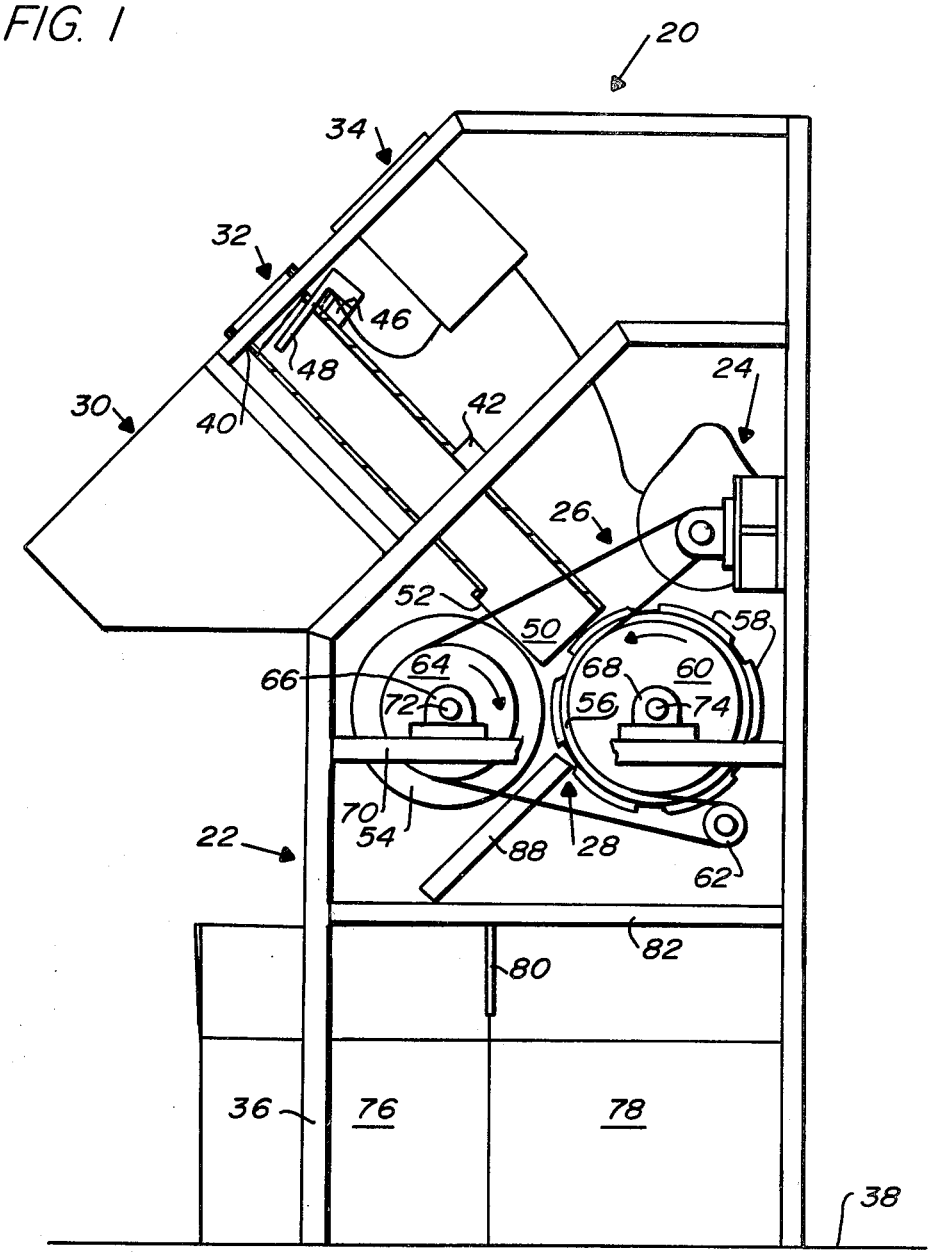
FIG. 1 is a side elevation view, partially broken away to show details of construction, of a can sorting, counting and flattening machine constructed in accordance with a preferred embodiment of the present invention.
Figure 2:
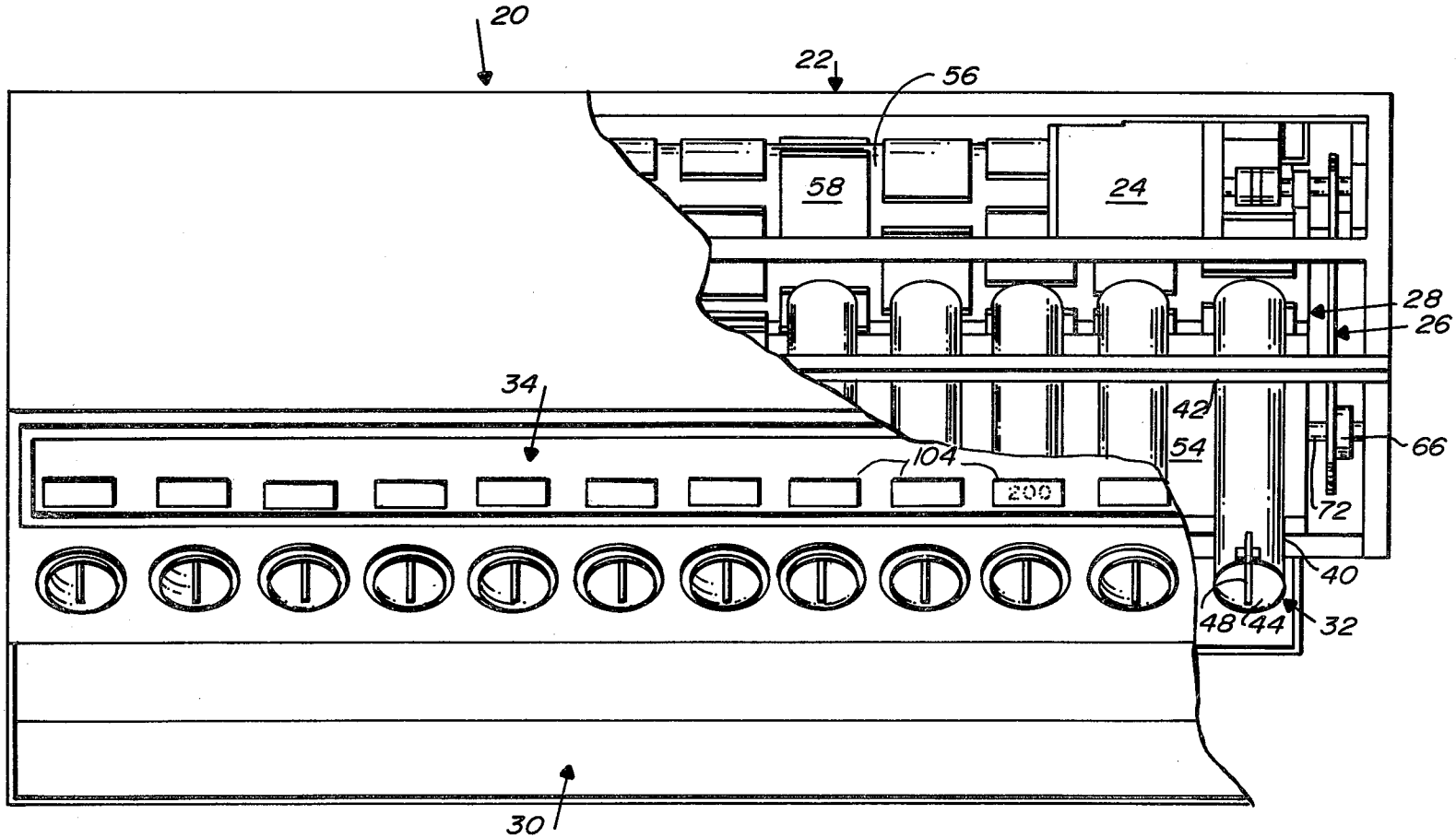
FIG. 2 is a top plan view, partially broken away, showing details of certain elements of the invention including the can tubes and flattening rollers.
Figure 3:
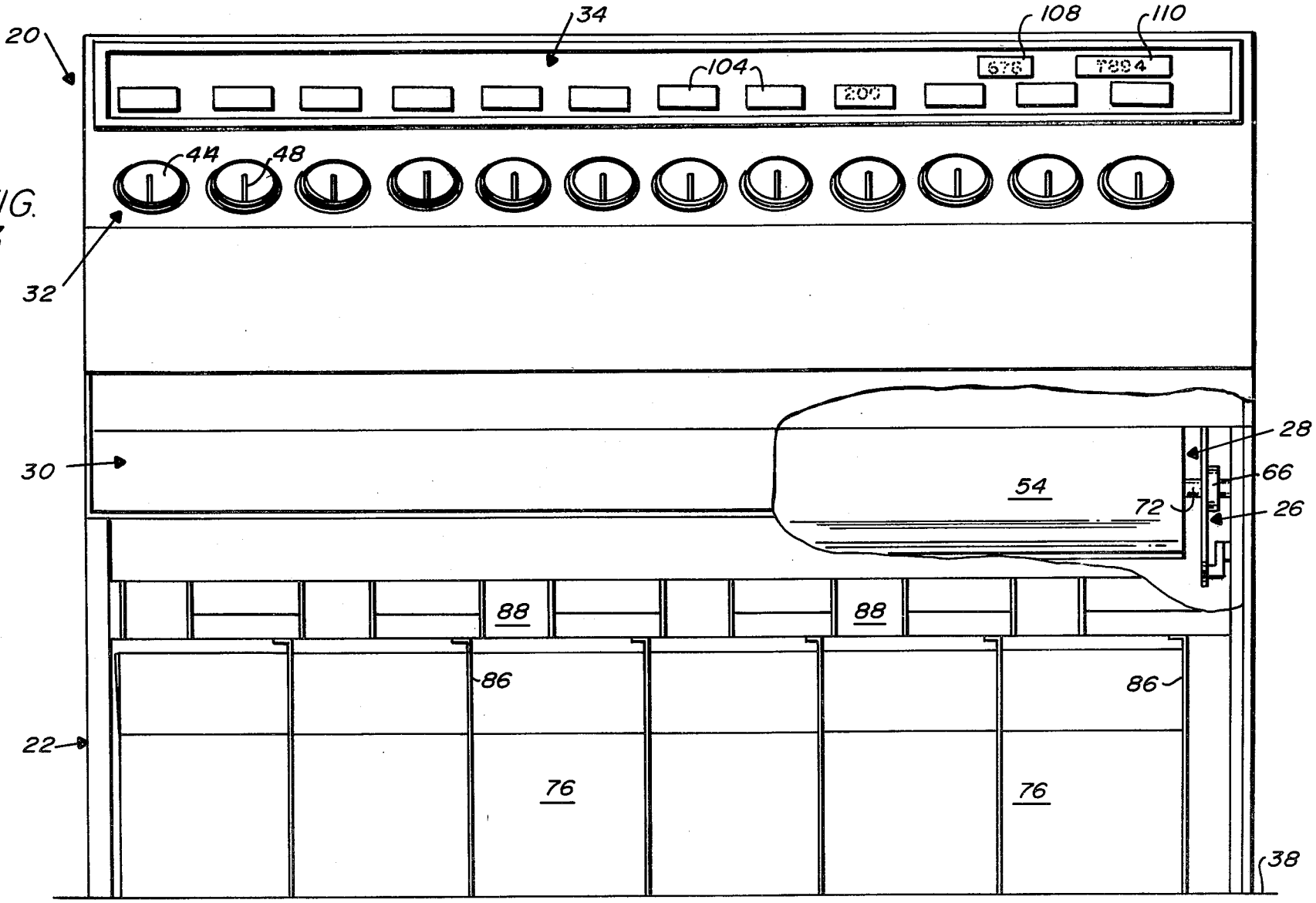
FIG. 3 is a front elevation view, partially broken away, illustrating details of specific elements of the invention including the master control panel.

A can sorting, counting and flattening machine constructed in accordance with the preferred embodiment of the present invention is indicated generally by the reference numeral 20 in FIG. 1 taken in conjunction with FIGS. 2 and 3.

The machine 20 comprises a main frame structure 22, a drive motor 24, a drive chain arrangement 26, can flattening rollers 28, a can receiving bin 30, can sorting tubes 32, an arrangement of discharge chutes 88 located at the discharge side of the rolls that directs the separation of the flattened cans to an appropriate collection container, and a master control panel 34 having an electronic counter mechanism. Each of these components of the machine will be described in greater detail below.

The main frame 22 has legs 36 which support the machine 20 on a floor or other surface 38. The can receiving bin 30 is preferrably formed of sheet metal rigidly connected to the main frame 22. The bin 30 extends laterally across the front of the machine and forms an open top hopper into which an operator may dump several hundred cans of various brand names.

As best shown in FIG. 1 and 2, the can tubes 32 are rigidly connected to the upper portion of the main frame at 40 and 42. Although twelve can tubes are shown, any number of can tubes could be provided depending upon the number of soft drink and beer can brands distributed in the locality in which the machine is used.

In addition, removable labels bearing the brand names of the cans may be attached and removed from the can tubes 32 as desired. For example, using the twelve can tubes 32 shown, four tubes could be labeled for soft drink cans and eight tubes could be labeled for beer cans.

The can tubes 32 have open top ends 44 which are conveniently located above the can bin 30. This arrangement allows an operator to stand or sit in front of the machine and easily select a branded can from the bin and drop it into the correspondingly branded can tube.

After the can is dropped into the properly selected can tube 32 it slides downwardly under the force of gravity. A counter activating switch 46 is located in each can tube. Each counter activating switch has a counter weighted or spring biased wand 48 which is tripped each time a can slides down a tube 32.

Each time the counter activating switch wand 48 is tripped by a can the can is counted and the can count is displayed on the master control panel 34. The details of the counting mechanism and its functions will be described at a later point in the description.

The bottom end 50 of each can tube is open ended and also has an open side 52 facing one of the can flattening rollers 54. The open side 52 is just a little longer and wider than the length and width of a standard sized beverage can.

The roller 54 has a smooth circumferential surface and is spaced from a juxtaposed roller 56 so that the rollers do not directly engage each other. The distance between the rollers at their closest point determines how flat the flattened can will be. Preferably the distance would be in a range of $\frac{1}{8}$ to $\frac{3}{8}$ inch.

The outer circumferential surface of roller 56 is provided with a series of spaced apart raised cleats 58. The details of the rollers 54 and 56 and the details of the raised cleats 58 on roller 56 form one of the unique features of the present invention and will be discussed in greater detail at a later point in the description.

Briefly, the rollers 54 and 56 function to perform the can flattening operation as follows. The motor 24 drives an endless drive chain 26 around a drive sprocket 60 associated with roller 56 thereby rotating roller 56 in a counter-clockwise direction. The drive chain then rotates around an idler sprocket wheel 62 which is arranged to drive sprocket 64 of roller 54 so that roller 54 rotates in a clockwise direction. Suitable bearings 66 and 68 are mounted on main frame cross member 70 to rotatably support main shafts 72 and 74 of the respective rollers 54 and 56.

A can which is located at the open bottomed and open sided end 50, 52 of a given can tube will rest on the smooth circumference of clockwise rotating roller 54 until the end of said can is contacted by one of the raised cleats 58 associated with counter-clockwise rotating roller 56. Once the can end is contacted by cleat 58 the can body will be immediately and precisely folded over the can end so that all identifying indicia provided on the can end are easily readable after the can has been completely flattened by the rollers 54 and 56.

As shown in FIGS. 2 and 3 the rollers 54 and 56 extend lengthwise across the entire machine. FIG. 1 taken in conjunction with FIG. 3 shows two rows of boxes 76 and 78 positioned under the machine below the can flattening rollers shown generally at 28.

Each row 76 and 78 of boxes contains six boxes per row. A vertical box guide 80 extends lengthwise across the entire machine and is secured to main frame cross members 82, one of which is shown in FIG. 1. The box guide 80 is located to the left of the center point between rollers 28 (see FIG. 1).

As viewed in FIG. 1 the six boxes of box row 76 are inserted from the left side of the machine until they engage vertical box guide 80 and the six boxes of box row 78 are inserted from the right side of the machine until they engage vertical box guide 80.

In addition, as shown in FIG. 3, a plurality of brackets 86 provide box guides for locating each box in proper lateral position beneath the machine 20.

A series of six spaced apart can chutes 88 are suitably secured to cross frame members 70 and 82. The can chutes are only provided for the six boxes of box row 76. No can chutes are necessary for the six boxes of box row 78 because the flattened cans fed from, for example, even numbered can tubes 32 will fall directly into the boxes of box row 78. This is due to the fact that vertical box guide 80 is positioned to locate box row 78 below the center point between the rollers 28.

Although not shown in the drawings, the machine could easily be modified to allow the boxes of each box row 76 and 78 to be inserted from the front or bin side of the machine.

In such a modified arrangement the vertical box guide 80 would be eliminated and the operator would insert the boxes of both box rows 76 and 78 from the front or left side of the machine as shown in FIG. 1. Also, can chutes as shown at 88 for the front box row 76 could also be provided for the back box row 78.

Figure 4:
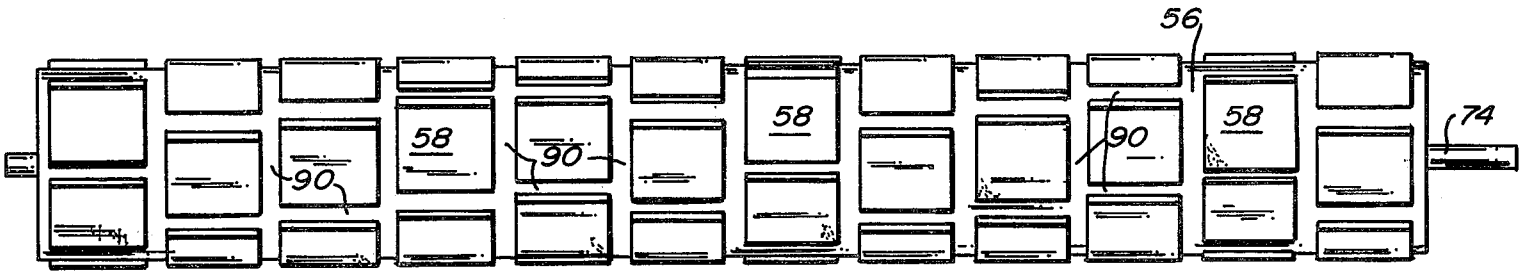
FIG. 4 is a front elevation view illustrating the details of a cleated flattening roller which comprises one of the unique features of the invention.
Figure 5:
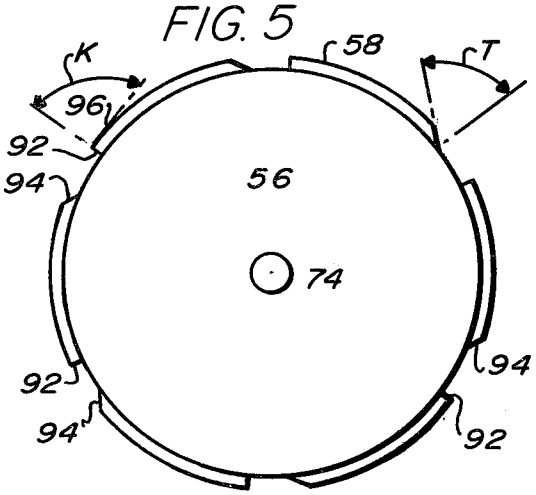
FIG. 5 is an end view showing the details of the cleats associated with the cleated flattening roller of FIG. 4.

FIGS. 4 and 5 show the details of roller 56 and associated raised cleats 58 thereon which form one of the unique features of the invention.

In the preferred embodiment of the invention, utilizing anywhere from two to twelve can tubes 32, there are equivalent rows of cleats 58 positioned longitudinally across roller 56. As shown in FIGS. 4 and 5 each row comprises six cleats 58 equally spaced about the circumference of roller 56 and preferably spot welded to roller 56.

The total number of cleats 58 in the preferred embodiment is 72. As shown in FIG. 4 the cleats of each row are phased or staggered with respect to the cleats of each adjacent row so that the spaces or gaps 90 between each cleat 58 of any given row do not coincide with the gaps 90 between the six cleats 58 of any adjacent row.

Moreover, in the preferred embodiment the gaps 90 between cleats 58 are longitudinally "aligned" across the length of roller 56 so that on any given longitudinal axis across roller 56 only three rows of cleats 58 have their gaps 90 longitudinally aligned.

The above described cleat phasing feature eliminates any possibility of cans being flattened between rollers 54 and 56 from jamming or overloading the machine because at any given time only three or four cans are actually in the critical phase of the can flattening process and none of these are being flattened in adjacent cleat rows.

FIG. 5 illustrates the details of the cleats themselves. Each cleat 58 has a leading edge 92 and a trailing edge 94.

The leading edge 92 of each cleat 58 is located on a radial extension emanating from the center of roller 56 and is substantially perpendicular to a tangent at the point where the leading edge is formed on the roller. This feature is illustrated in FIG. 5 wherein a 90 degree angle K between the leading edge 92 and a tangent line 96 on roller 56 is shown.

In a similar manner the trailing edge 95 is formed at an angle T of approximately 45 degrees.

In the preferred embodiment the height of each cleat radially outwardly from the circumference of roller 56 is approximately ½ inch. The arcuate length of each cleat is approximately 4¼ inches with the arcuate distance between each cleat being approximately 1¾ inches. The width of each cleat is approximately 5 inches and the distance between adjacent cleat rows is approximately one inch.

Figure 6:
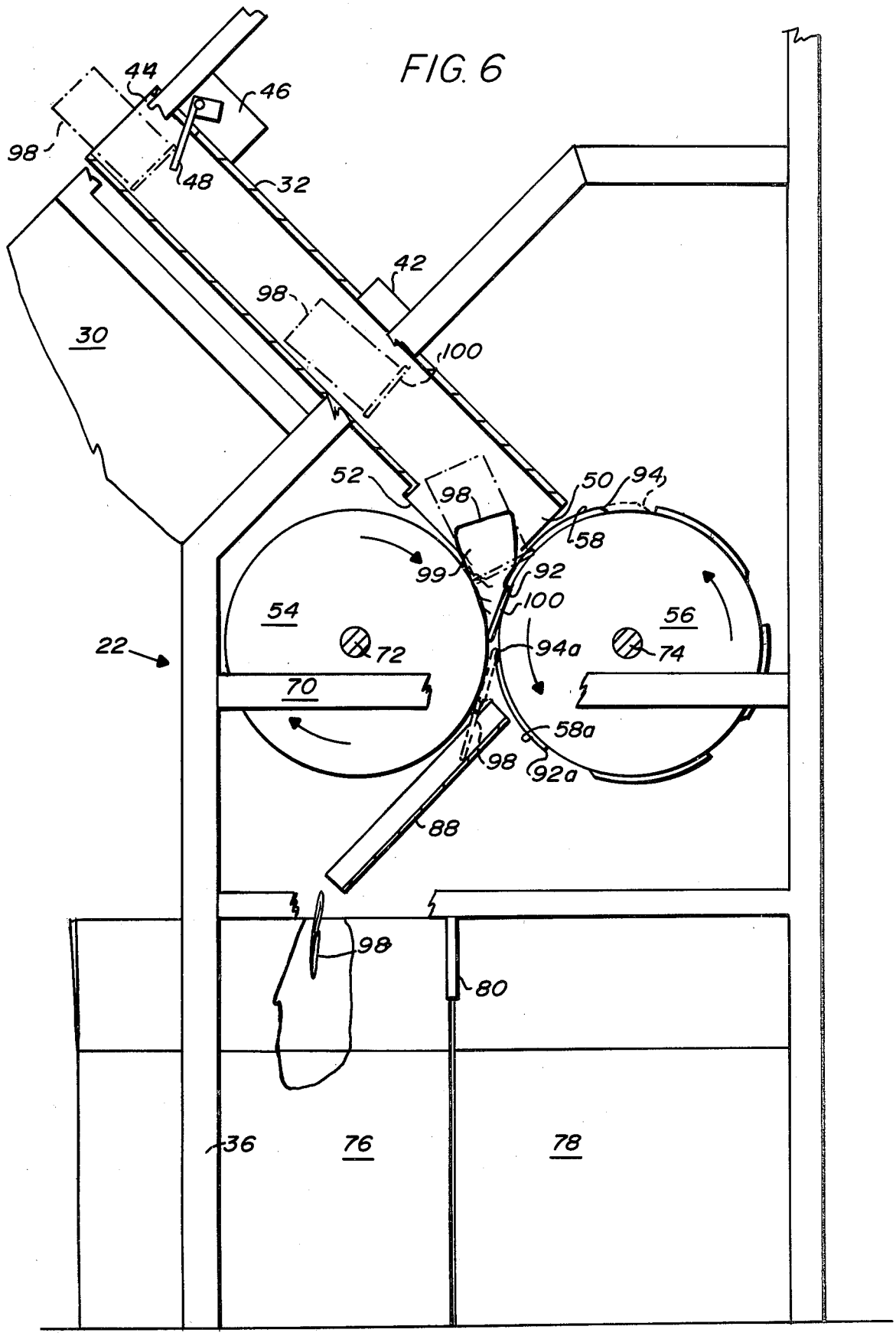
FIG. 6 is an enlarged side elevation view, partially broken away to illustrate the unique manner in which a can is sorted, counted, flattened and stored by the machine of the present invention.

FIG. 6 illustrates in detail the manner in which a beverage can is fed into a can tube 32, counted, flattened between rollers 54 and 56, and discharged into a storage box.

An operator selects a branded can 98 from the can bin 30. Beverage cans of this type have various indicia marked on the ring end 100 where the can is opened for drinking.

The operator then inserts the branded can 98 into the similarly branded can tube 32 with ring end 100 going into the tube first. As the can slides down can tube 32 the wand 48 of counter activating switch 46 is tripped, the can is counted, and the can count displayed on the master control panel 34.

The can 98 slides down to the open ended 50 and open sided 52 end of can tube 32. At this time the can 98 comes into contact with the smooth outer surface of roller 54.

The can 98 rests in this position until the ring end 100 is contacted by perpendicular engagement with the leading edge 92 of cleat 58.

As best shown in dotted outline in FIG. 6, once contact is made between the ring end 100 of can 98 and the leading edge 92 of cleat 58, the body portion 99 of the can is literally folded over the back side of the ring end 100 between the juxtaposed rollers 54 and 56. The flattened can 98 then slips out from between the rollers 54 and 56 and slides down chute 88 into one of the boxes of box row 76.

The trailing edge **94*a* of adjacent preceding cleat 58*a* forms a relief angle to ensure that the ring end 100 of can 98 cannot become wedged or jammed between cleats 58 and 58*a* but instead will easily be propelled into chute 88 by the centrifugal force imparted from roller 56**.

The configuration of the cleats 58, the relative diameters of rollers 54 and 56, and the relative speeds of the rollers 54 and 56 are all of particular importance in producing a flattened can wherein the body of the can 99 is folded over the ring end 100 of the can so that the ring end 100 is not distorted and all identifying indicia provided on the ring end 100 are easily readable.

In general, the parameters under which this desired unique type of flattening occur are as follows.

Firstly, the roller 54 must be smooth and the best results have been obtained when the diameter of roller 54 is somewhat smaller than the diameter of roller 56.

Very good results have been obtained when the diameter of roller 56 is approximately 5% larger than roller 54. This 5% diameter difference appears to work quite well when the roller diameters per se are in an overall range between 9 and 20 inches, with corresponding cleat number increases.

Another important parameter relates to the relative speed between the rollers 54 and 56. Best results are obtained when the roller 54 rotates at higher RPM and higher surface feet per second than roller 56.

For roller diameters having an overall range between 9 and 20 inches excellent results have been obtained by rotating the smooth and smaller diameter roller 54 at about 1.25 to 1.45 times as fast as roller 56. For example, if roller 56 is rotated at 4 RPM then roller 54 would be rotated at approximately 5.4 RPM.

All of these parameters are important in order to achieve the desired result of a flattened can wherein the can body has been folded over the ring end of the can without any distortion to the ring end.

Figure 7:
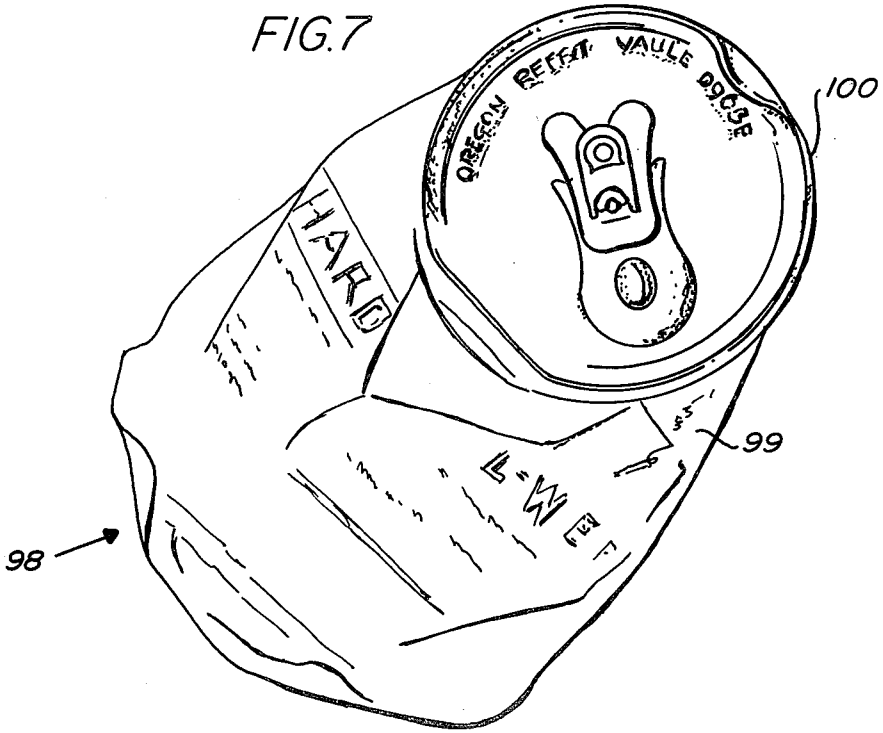
FIG. 7 is a top plan view illustrating a can which has been flattened by the apparatus of the present invention so that the can body has been folded over the back side of the ring end of the can whereby all identifying indicia on the ring end are easily readable.

FIG. 7 illustrates a can 98 which has been flattened by the unique can flattening process of the present invention. It should be noted that the can body 99 has been folded over the ring end 100 of the flattened can.

All identifying indicia on the ring end 100 are as easily readable on the flattened can as they would be on an unflattened can. Moreover, because the can body 99 is flattened as an integral unit, the brand name on the can is always easy to read. In fact, in actual operation the can flattening machine of the present invention will process cans which have already been partially flattened or badly distorted by the user just as well as it will process a completely undistorted can.

This latter feature, the ability of the machine to flatten either badly distorted cans or completely undistorted cans with equal facility, is a very important aspect of the present invention. Prior art devices simply have not been able to properly function with partially distorted cans so that the identifying indicia on the ring end of the can as well as the brand name of the can are readable after the can has been completely flattened.

The machine of the present invention functions so well that 100% readability of the identifying indicia on can end 100 is always obtained when the operator inserts the can 98 into a can tube 32 by inserting the ring end 100 first. Moreover, in actual operation it has been found that nearly 100% of the identifying indicia on the ring end 100 are easily readable even when the operator mistakenly inserts the can 98 into a can tube 32 with the ring end up (as viewed in FIG. 6).

The machine works so well that it is in fact dependent upon the operator only to associate a given branded can with the correspondingly branded can tube. From that point on the machine functions to count, flatten and sort the cans into individual storage boxes beneath the machine. All the operator need to do is place the branded cans in the proper can tubes and remove and replace storage boxes located beneath the machine when signaled by the machine's master control panel 34 that a particular branded box contains the desired count of flattened cans of that particular brand.

While the unique can flattening process provides an obvious advantage over current methods and machines presently used in this industry, the process and machine of the present invention also provides a unique counting function not available in the prior art.

The counting function of the invention can best be understood by viewing FIG. 3 in conjunction with FIG. 6. The master control panel 34 is provided with twelve resettable counters 104.

Each resettable counter 104 is associated with an individual one of the twelve can tubes 32. Each time a can 98 trips the wand 48 of counter activating switch 46 in any given can tube 32, the count is immediately displayed by the appropriate associated counter 104 located immediately in front of the operator on control panel 34.

The counters or registers 104 are not shown in detail in the drawing but are resettable and may be mechanical or electronic as will be readily understood by those skilled in the art. Thus, the operator, by looking at the counter display, may see at a glance how many cans have been processed through the machine into the storage box below the machine associated with any given branded can tube 32.

Each counter register 104 is preferably provided with an associated red light and/or buzzer (not shown) which will be activated when the count at that particular register reaches a given total number. If, for example, the individual boxes in box rows 76 and 78 are of a size to accommodate 200 flattened cans, the warning light or buzzer will be activated. The operator then removes the full box, places it with an empty box and pushes a button or switch (not shown) on the counter register 104 which resets that particular counter to zero.

The twelve can tube counters 104 are also interconnected with a resettable customer counter 108. The customer counter 108 functions to display on the master control panel 34 the total number of cans processed by the machine for a given customer and the count displayed thereon is independent of the count displayed on the individual can tube counters 104.

In other words, the customer counter 108 is reset to zero by the operator each time a new customer wants the store owner to process a batch of cans through the can flattening machine. The operator merely dumps all of the cans from that customer into the can bin 30, sets the customer counter 108 to zero, and after all the cans are processed through the machine both the customer and the machine operator know the total number of cans returned by the customer by glancing at the number displayed by customer counter 108.

A grand total counter is provided on the master control panel at 110. This counter 110 is interconnected with each of the twelve can tube counters 104.

The grand total counter 110 is nonresettable and functions to keep a running grand total of all the cans processed through the machine on a daily or weekly basis. In this manner a store owner can keep an accurate record of the number of cans which he receives from the various retail customers versus the number of cans he is returning to the distributors. Accordingly, if there is a large discrepancy between these two totals, the store owner will be quickly alerted and can take measures to investigate the cause of the discrepancy.

The machine 20 is small enough and inexpensive enough to be installable at almost any retail outlet which sells deposit type beverage cans and to which empty beverage cans are returned.

While we have illustrated and described the preferred embodiments of our invention, it is to be understood that these are capable of variation and modification, and we therefore do not wish to be limited to the precise details set forth, but desire to avail ourselves of such changes and alterations as fall within the purview of the following claims.

We claim:

1. A method of sorting, counting, and flattening a plurality of various brand name cans, each can having identifying indicia provided on a ring end thereof, comprising:

(a) providing a plurality of branded can tubes to receive the different can brand names;

(b) feeding the branded cans to correspondingly branded can tubes;

(c) counting each can as it passes through a branded can tube;

(d) providing a pair of juxtaposed flattening rollers at an outlet end of each of the branded can tubes, and providing one of the rollers with a surface configured to produce a gripping effect on the ring end of a can;

(e) rotating the rollers in opposite directions relative to each other;

(f) flattening the cans between the rotating rollers in a manner whereby the body of the can is folded over the back side of the ring end of the can so that all identifying indicia on the ring end are easily readable; and, (g) collecting by brand name the sorted, counted and flattened cans in individual containers located downstream from the rotating rollers.

2. A method of flattening cans which have identifying indicia on their ring ends, comprising:

(a) feeding the cans between a pair of rollers;

(b) rotating the rollers in opposite directions relative to each other; and, (c) flattening the cans between the rotating rollers in a manner whereby the body of the can is folded over the back side of the ring end of the can so that all identifying indicia on the ring end are easily readable.

3. The method defined in claim 2 wherein one roller is configured to produce a gripping effect on the ring end of the can.

4. A method of counting and flattening brand name cans having identifying indicia printed on the ring end and which are returned by individual customers to a retail outlet, said method comprising:

(a) providing a plurality of branded can tubes to receive the different can brand names;

(b) feeding each branded can to a correspondingly branded can tube;

(c) selectively counting by brand name each can which passes through a branded tube;

(d) flattening the cans between a pair of oppositely rotating rollers in a manner whereby the body of the can is folded over the backside of the ring end of the can so that all identifying indicia on the ring end are easily readable;

(e) simultaneously counting and totaling both the total number of each brand of cans supplied by an individual customer and the total number of cans of all brands supplied by an individual customer.

5. A flattening device for flattening brand name cans having identifying indicia printed on the ring end and returned by individual customers to a retail outlet, said device comprising, a pair of juxtaposed rollers, surface means on one roller for producing a gripping effect on one end of a can, rotating means for rotating the rollers in opposite directions relative to each other, said surface means being configured to cause the body of the can to be folded over the back side of said one can end to ensure that all identifying indicia provided on said one can end are peserved and are easily readable after the can has been completely flattened by said rollers.

6. The invention defined in claim 5 wherein said surface means on said one roller comprises a series of spaced apart raised cleats located on the circumference of said one roller.

7. The invention defined in claim 5 wherein the other roller has a smooth circumferential surface.

8. The invention defined in claim 6 wherein each cleat has a leading edge located on a radial extension of said one roller and which edge is substantially perpendicular to a tangent at the point where said leading edge is formed on said one roller.

9. The invention defined in claim 8 wherein each cleat has a trailing edge downstream from said leading edge and which forms an angle of approximately 30° to 60° with said leading edge.

10. A can flattening device comprising, a pair of juxtaposed rollers, surface means on one roller for producing a gripping effect on one end of a can, rotating means for rotating the rollers in opposite directions relative to each other, said surface means being configured to cause the body of the can to be folded over the back side of said one can end to ensure that all identifying indicia provided on said one can end are easily readable after the can has been completely flattened by said rollers, and wherein said one roller has a larger outer diameter than the other roller.

11. The invention defined in claim 10 wherein said other roller has a smooth circumferential surface.

12. A can flattening device comprising, a pair of juxtaposed rollers, surface means on one roller for producing a gripping effect on one end of a can, rotating means for rotating the rollers in opposite directions relative to each other, said surface means being configured to cause the body of the can to be folded over the back side of said one can end to ensure that all identifying indicia provided on said one can end are easily readable after the can has been completely flattened by said rollers, and wherein said rotating means rotates said one roller at slower rpm and slower surface feet per second than the other roller.

13. A can sorting, counting and flattening machine comprising:

(a) a can bin for receiving a plurality of unsorted, uncounted and unflattened cans having various brand names thereon;

(b) sorting means for receiving and sorting the cans according to brand name;

(c) counting means operatively associated with the sorting means for sensing and counting the passage of each sorted can through the sorting means;

(d) flattening means including a pair of oppositely rotating rollers operatively associated with said sorting means and said counting means for flattening each sorted can in a manner whereby the body of the can is folded over the back side of the ring end of the can so that all identifying indicia on the ring end are easily readable; and (e) storage means located downstream from said flattening means for storing each brand name group of sorted, counted and flattened cans.

14. The invention of claim 13 wherein said sorting means comprises a plurality of branded can tubes to accommodate each of the different can brand names.

15. The invention of claim 14 wherein the counting means comprises counter activating switches operatively associated with the branded can tubes for counting a can each time a can is passed through a branded can tube.

16. The invention of claim 13 wherein said flattening means comprises, surface means provided on one roller for providing a gripping effect on one end of a can; and means for rotating the rollers in opposite directions relative to each other.

17. The invention defined in claim 16 wherein said surface means on said one roller comprises a series of spaced apart raised cleats located on the circumference of said one roller.

18. The invention of claim 17 wherein each cleat has a leading edge located on a radial extension of said one roller and which edge is substantially perpendicular to a tangent at the point where said leading edge is formed on said one roller.

19. The invention of claim 18 wherein each cleat has a trailing edge downstream from said leading edge and which forms an angle of approximately 45° with said leading edge.

20. The invention defined in claim 16 wherein the other roller has a smooth circumferential surface.

21. The invention of claim 13 wherein said storage means comprises a plurality of removable containers, each container arranged to receive flattened cans from a specific branded can sorting means.

22. The invention of claim 21 wherein said storage means further comprises box guide means operatively associated with the machine for slidably receiving each box in a specific predetermined position downstream of said flattening means whereby a full box may be quickly and easily replaced with an empty box.

23. A can sorting, counting and flattening machine comprising:

(a) a can bin for receiving a plurality of unsorted, uncounted and unflattened cans having various brand names thereon;

(b) sorting means for receiving and sorting the cans according to brand name;

(c) counting means operatively associated with the sorting means for sensing and counting the passage of each sorted can through the sorting means;

(d) flattening means operatively associated with said sorting means and said counting means for flattening each sorted can in a manner whereby the body of the can is folded over the back side of the ring end of the can so that all identifying indicia on the ring end are easily readable; and (e) storage means located downstream from said flattening means for storing each brand name group of sorted, counted and flattened cans, and wherein said sorting means comprises a plurality of branded can tubes to accommodate each of the different can brand names and wherein the counting means comprise counter activating switches operatively associated with the branded can tubes for counting a can each time a can is passed through a branded can tube and wherein the counting means further comprises means for selectively counting by brand name each can passing through a branded tube; and, means for simultaneously counting and totaling both the total number of each brand of cans supplied by an individual customer and the total number of cans of all brands supplied by an individual customer.

24. A can sorting, counting and flattening machine comprising:

(a) a can bin for receiving a plurality of unsorted, uncounted and unflattened cans having various brand names thereon;

(b) sorting means for receiving and sorting the cans according to brand name;

(c) counting means operatively associated with the sorting means for sensing and counting the passage of each sorted can through the sorting means;

(d) flattening means operatively associated with said sorting means and said counting means for flattening each sorted can in a manner whereby the body of the can is folded over the backside of the ring end of the can so that all identifying indicia on the ring end are easily readable;

(e) storage means located downstream from said flattening means for storing each brand name group of sorted, counted and flattened cans, and wherein said flattening means comprise, (a) a pair of juxtaposed rollers;

(b) surface means provided on one roller for providing a gripping effect on one end of a can;

(c) means for rotating the rollers in opposite directions relative to each other, and wherein said one roller has a larger outer diameter than the other roller.

25. A can sorting, counting and flattening machine comprising:

(a) a can bin for receiving a plurality of unsorted, uncounted and unflattened cans having various brand names thereon;

(b) sorting means for receiving and sorting the cans according to brand name;

(c) counting means operatively associated with the sorting means for sensing and counting the passage of each sorted can through the sorting means;

(d) flattening means operatively associated with said sorting means and said counting means for flattening each sorted can in a manner whereby the body of the can is folded over the back side of the ring end of the can so that all identifying indicia on the ring end are easily readable;

(e) storage means located downstream from said flattening means for storing each brand name group of sorted, counted and flattened cans, and wherein said flattening means comprise, (a) a pair of juxtaposed rollers;

(b) surface means provided on one roller for providing a gripping effect on one end of a can;

(c) means for rotating the rollers in opposite directions relative to each other, and wherein said rotating means rotate said one roller at slower rpm and slower surface feet per second than the other roller.

* * * * *